US009174277B2

(12) United States Patent
Collura

(10) Patent No.: US 9,174,277 B2
(45) Date of Patent: Nov. 3, 2015

(54) LADLE SHROUD FOR LIQUID METAL CASTING INSTALLATION

(75) Inventor: Mariano Collura, Strepy-Bracquegnies (BE)

(73) Assignee: Vesuvius Group S.A., Ghlin (BE)

( * ) Notice: Subject to any disclaimer, the term of this patent is extended or adjusted under 35 U.S.C. 154(b) by 616 days.

(21) Appl. No.: 13/130,189

(22) PCT Filed: Nov. 19, 2009

(86) PCT No.: PCT/EP2009/008243

§ 371 (c)(1),
(2), (4) Date: Jun. 8, 2011

(87) PCT Pub. No.: WO2010/057639

PCT Pub. Date: May 27, 2010

(65) Prior Publication Data

US 2011/0248055 A1 Oct. 13, 2011

(30) Foreign Application Priority Data

Nov. 20, 2008 (EP) ..... 08169499

(51) Int. Cl.
*B22D 41/00* (2006.01)
*B22D 41/50* (2006.01)
*B22D 11/106* (2006.01)

(52) U.S. Cl.
CPC ..... *B22D 41/50* (2013.01); *B22D 11/106* (2013.01)

(58) Field of Classification Search
CPC .... B22D 11/106; B22D 41/50; B22D 41/502; B22D 41/56
USPC ..... 222/590, 591, 600, 606, 607; 266/236, 266/287; 164/435, 335, 337, 137
See application file for complete search history.

(56) References Cited

U.S. PATENT DOCUMENTS

| | | | | | |
|---|---|---|---|---|---|
| 4,290,589 | A | * | 9/1981 | Luhrsen et al. | 266/236 |
| 4,316,561 | A | | 2/1982 | Grosko | |
| 4,593,838 | A | | 6/1986 | Oberbach et al. | |
| 4,892,235 | A | | 1/1990 | King | |
| 4,995,535 | A | * | 2/1991 | Ooya et al. | 222/607 |
| 5,665,264 | A | * | 9/1997 | Sato et al. | 222/607 |
| 5,879,579 | A | * | 3/1999 | Yoshino et al. | 222/606 |

FOREIGN PATENT DOCUMENTS

| | | | | |
|---|---|---|---|---|
| EP | 0858851 | * | 1/1998 | B22D 41/56 |
| EP | 0858851 | A1 | 8/1998 | |
| FR | 2694711 | A1 | 2/1994 | |
| GB | 2171348 | A | 8/1986 | |
| JP | 7164117 | A | 6/1995 | |
| JP | 9108825 | A | 4/1997 | |
| JP | 1099947 | | 4/1998 | |

(Continued)

*Primary Examiner* — Scott Kastler
*Assistant Examiner* — Michael Aboagye
(74) *Attorney, Agent, or Firm* — Thomas Clinton; Donald M. Satina

(57) ABSTRACT

A ladle shroud for casting liquid metal contains a canal along which the metal can pass, extending essentially along an axis, and a metallic jacket positioned at an end portion of the shroud that corresponds to an end of the canal, characterized in that the jacket comprises at least a belt of a thickness greater than or equal to 10 mm, preferably of 14 mm, and in that the shroud comprises means of attachment to driving means, the attachment means being formed on the jacket, notably on the belt thereof.

9 Claims, 1 Drawing Sheet

(56) References Cited

FOREIGN PATENT DOCUMENTS

| | | | | | |
|---|---|---|---|---|---|
| JP | 11347718 | | 12/1999 | | |
| JP | 2004025203 | | 1/2004 | | |
| WO | 2004/052576 | A1 | 6/2004 | | |
| WO | WO 2004/052576 | * | 6/2004 | ..... | B22D 41/56 |

* cited by examiner

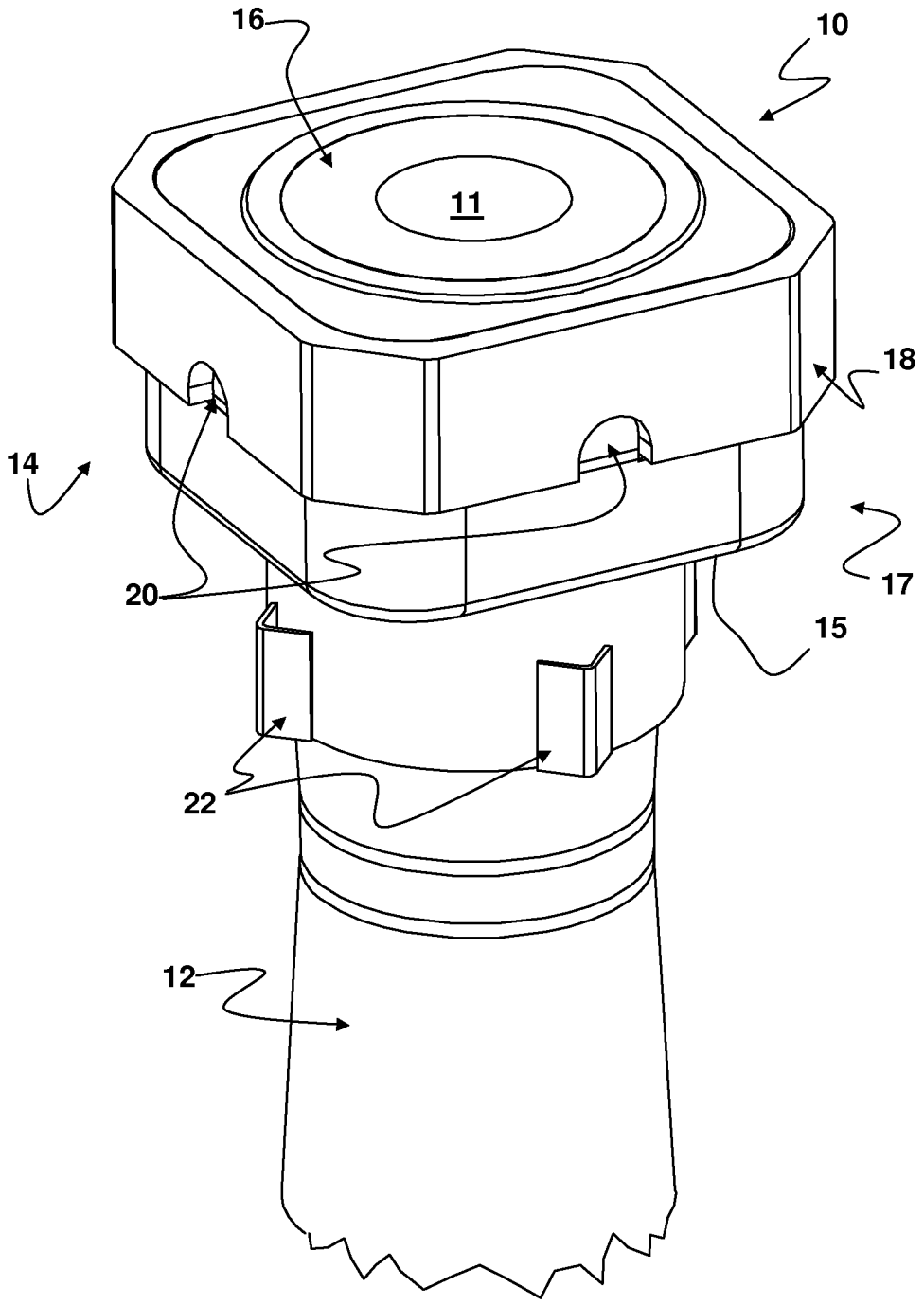
16
10
11
18
14
17
20
15
22
12

LADLE SHROUD FOR LIQUID METAL CASTING INSTALLATION

BACKGROUND OF THE INVENTION (1) Field of the Invention

The present invention relates to a casting installation for liquid metal and notably to a ladle shroud that can be introduced into such an installation.

(2) Description of the Related Art

A ladle shroud is a tube comprising a canal extending essentially along an axis; the canal allowing the liquid metal from a metallurgical container, such as a ladle, to pass to a tundish. Such a tube is introduced into the installation in such a way that the axis of the canal is vertical and that the upper end thereof is in contact with an upstream element of the installation, while the lower end thereof is immersed in the tundish.

A ladle shroud comprising, at an end portion of the shroud corresponding to an upper end portion of the canal, a metallic jacket framing a tube body is known from the prior art and this metallic jacket is of a thickness less than or equal to 5 millimeters. Such a jacket, because of its small size, serves only to reduce the inevitable dimensional tolerances that arise when manufacturing the shroud made of refractory material. In particular, such a jacket is entirely incompatible with the stress loadings (temperature, pressure) associated with the use of the shroud and, therefore, it is impossible to conceive of using this jacket to hold or position the ladle shroud. These problems are further exacerbated if there is a desire to use such shrouds in a device for introducing ladle shrouds by sliding because in such a case the loadings (tensile stress loadings for example) are even more localized than they are in a conventional push-fit device.

Before introducing the shroud into the installation, the end portion of the shroud may be fitted into a removable stiffening frame (see, for example, WO-A1-2004/052576). This frame is then placed on a support and the shroud and frame assembly is introduced into the casting installation so that the end portion of the shroud is in contact with the upstream element of the casting installation.

The fitting of such a frame is a fairly length and relatively complex operation for the operator to perform. Such a frame is also extremely expensive. There is therefore a need to simplify the operations in the casting installation, notably in order to reduce the costs associated with casting.

BRIEF SUMMARY OF THE INVENTION

To this end, one subject of the invention is a ladle shroud for casting liquid metal, comprising a canal along which the metal can pass, extending essentially along an axis, and a metallic jacket positioned at an end portion of the shroud that corresponds to an end of the canal, the jacket comprising at least one part of a thickness greater than or equal to 10 mm, preferably of 14 mm, the shroud also comprising means of attachment to tube drive means, the attachment means being formed on the jacket, notably on the thick part thereof.

Thus, because of the thickness of its jacket, the shroud according to the invention is more robust than a shroud of the prior art and is better able to withstand the loadings, particularly the tensile stress loadings, that it is likely to experience in the end portion that forms the upper end of the shroud when this shroud is introduced into the installation. Because the shroud further comprises means of attachment to tube driving means, these means consisting for example of a support allowing the shroud to be moved and held in the casting installation, and because its mechanical properties are sufficient, it is possible to dispense with the presence of a frame.

That makes it possible to simplify the process of introducing the shroud into the installation because the step of fitting the shroud into the frame, which requires that the shroud be manipulated by the operator, is omitted. The fitting of the shroud in the installation is therefore quicker and less expensive.

Further, when the shroud has already been used and is scrapped, a step of separating the frame and the shroud is no longer needed. This operation is in fact often made very difficult by the droplets of set steel which have been splashed during the casting operations. These set steel droplets weld together the constituent parts of the frame of the prior art.

In addition, because the frame has been omitted, the shroud introduced into the installation is not as heavy as the casting element of the prior art which comprises both the shroud and the frame. It is therefore also possible to simplify the toolings that holds the ladle shroud in the casting installation and that moves the shroud. The costs relating to casting are thereby further reduced.

Finally, the thickness of the belt means that notches can be formed therein and these notches, collaborating with a ladle shroud holding and/or positioning device, will serve to hold, support or introduce the ladle shroud in the casting position without the risk of the metallic jacket becoming broken or deformed during the course of use.

The invention also comprises one or more of the features from the following list:

- in the end portion, the shroud comprises at least a cross section normal to the axis of the canal which has a distinct shape and/or differs in size from a cross section of another portion of the shroud, the cross section in the end portion being in particular rectangular, preferably square. Thus, the cross section of the end portion is modified in relation to the cross section of the remainder of the shroud, which is generally circular, so as to be fitted to existing casting installations and supports that accept a shroud fitted with a frame. Further, because the end portion has a square cross section, it becomes easier for the latter to be positioned in the installation and/or on the support,
- the metallic jacket is produced as a single piece. This then avoids the need for a connecting operation, notably one using welding, to connect the various parts of the jacket, as is performed in the prior art. This too then simplifies the method of manufacture of the shroud. Further, with a jacket made as a single piece, the robustness of the shrouds improves and this means that the thickness of the jacket and the weight of the shroud can further be reduced slightly,
- the tube comprises a tube body made of a first material, a second material being overmoulded onto the body in the end portion of the shroud, particularly between the body and the jacket. Thus, such a shroud is manufactured using a simple manufacturing method. Indeed it is more advantageous to manufacture the tube body for example by moulding, pressing or by extrusion than for the material to be overmoulded onto it than it is to manufacture as a single operation a shroud that comprises two different cross sections. Using this technique, the shroud of relatively complex form is manufactured in a simple and inexpensive way,
- the thick part of the jacket extends over at least one circumference of the shroud. That makes is possible to improve the robustness of the tube whatever the orientation in which it is positioned in the support and/or in the casting installation;

the shroud ends in the end portion in a planar surface. That being the case, the shroud is introduced into the casting installation by sliding, that is to say that the planar surface of the shroud is in contact with the directly upstream element of the installation and, during the course of casting, slides with respect to this element. That being the case, the stress loadings that the shroud experiences at the surface are relatively high tensile stress loadings that carry the risk of damaging the shroud. However, the thickness of the jacket is enough to ensure that the tube is sufficiently robust, even when the shroud is introduced into the installation by sliding.

Advantageously, the notches act as means for controlling the angular orientation of the shroud about its axis with respect to the upstream element, these means being able to give the shroud at least three distinct orientations. Thus, the casting element, notably the tube, can be introduced under the ladle in one or more predetermined orientations. As a result, each time the shroud is reused, the angular orientation in which it will be placed relative to the upstream element of the installation can be controlled, possibly as a function of the angular orientations in which it was positioned during previous uses.

It therefore becomes possible to obtain better distribution of internal tube wear. Specifically, the stream leaving a steel casting ladle is slightly oriented, especially when, between the ladle and the ladle shroud, there is a valve known as a "slide valve" that comprises an opening that can be partially closed off during casting. When this opening is in the partially closed off position, the stream of liquid metal follows a sinusoidal movement: it is directed more particularly towards a given portion of an internal wall of the shroud, of which it is so to speak reflected to be directed to an opposite portion of the wall, etc. Now, the portions of the internal wall of the ladle shroud to which the stream is directed wear more rapidly than the rest of this wall, because of the high temperature to which the liquid metal is raised. Thus, by distributing the wall portions most likely to become worn according to use, the internal wear of the wall of the tube is made uniform and the tube does not have to be scrapped because just one portion of the internal wall is very much more worn by comparison with the others (such a configuration being possible when the orientation of the tube is a random one). The life of the shroud is therefore lengthened.

Further, thanks to the orientation control means, it is easy to orient the stream of liquid metal because the position in which the shroud will be placed in the installation is exactly known. It will therefore be possible for example for the shroud to be equipped with apertures so that the stream flows in one or more favoured direction in the tundish. That makes it possible to improve the casting efficiency.

Another subject of the invention is a method of manufacturing a ladle shroud according to the invention comprising a body made of a first material and a second material overmoulded onto the body, in which:

the tube body is made of the first material, the metallic jacket is slipped over the tube body so that this jacket is positioned at the end portion of the shroud, the second material is overmoulded between the jacket and the tube body.

The method makes it possible to manufacture the shroud according to the invention in a simple and inexpensive way.

BRIEF DESCRIPTION OF THE DRAWING

The invention will be better understood from reading the description which will follow, given solely by way of example and made with reference to the single FIGURE which is a perspective view of an end portion of a ladle shroud according to one particular embodiment of the invention.

DETAILED DESCRIPTION OF THE INVENTION

The FIGURE depicts a ladle shroud 10 for a liquid metal, notably liquid steel, casting installation. The shroud 10 comprises a canal 11 along which the metal can pass, extending essentially along an axis, the axis being vertical when the shroud is in the position of use. The FIGURE notably depicts an upper end of the shroud when this shroud is in its position of use, that is to say an end able to be in contact with an upstream element of the casting installation.

The shroud comprises a tube body 12 made of a refractive material and, at its end, a head 14 of square cross section with a shape distinct from a cross section of the tube body 12, which is of circular cross section. The cross section is defined as being normal to the axis of the canal 11.

Further, the square cross section of the head 14 is larger in size than the circular cross section of the tube body 12 and, as a result, between the head 14 and the body 12 of the shroud, the ladle shroud 10 comprises a return surface 15 that is essentially horizontal and faces towards the lower end of the shroud when the shroud is in its position of use. Thus, the head of the shroud differs in shape and size from the rest of the shroud. It is able to reproduce the dimensions of a casting element of the prior art comprising a frame and can therefore be fitted to existing casting installations or existing tube handling devices.

At its end, the head 14 of the shroud ends in a planar contact surface 16. This surface 16 is notably capable of coming into contact with an upstream element of the installation and is loaded in tension, because it slides against the upstream element.

Further, as may be seen in the FIGURE, a jacket 17 made as a single piece is arranged around an end portion of the tube body 12. This jacket 17 is made of a metallic material, notably of steel, and covers the entire head 14 and an upper part of the tubular part of the shroud 10.

The jacket 17 comprises an annular portion forming a belt 18 of a thickness greater than the rest of the jacket. The thickness of the belt 18 is greater than 10 millimeters, preferably than 14 millimeters, whereas the rest of the jacket is of a thickness of between 2 and 7 millimeters, preferably between 4 and 6 millimeters. The belt 18 of the metallic jacket is formed in the portion in which this jacket covers the head 14.

Further, the jacket 17 comprises means 20 of attachment, for example four notches, formed in the belt 18 of the jacket, notably in the lower part of this belt. The four notches are identical. They allow the shroud to be attached to tube driving means, these driving means notably consisting of a tube manipulator arm or an H-shaped support that holds the shroud in the installation. Each notch is situated on a distinct side of the head 14, in the middle of this side.

The notches are delimited by abutment surfaces capable of collaborating with complementary abutment surfaces of pins of the tube support. In particular, two notches, situated on opposite sides of the head 14, collaborate with two pins of the support. Because the shroud comprises four notches, it can be given several angular orientations about the axis of the canal relative to the support and, as a result, relative to the upstream element of the installation. Specifically, because the notches are identical and uniformly distributed on the head, the shroud can be fitted on the support in four distinct orientations.

The metallic jacket 17 further comprises, in the portion covering the tubular part of the shroud, four identical fins 22 extending essentially along the axis of the canal and of triangular cross section. Each fin 22 is situated under one of the notches and the fins are therefore spaced 90° apart. The fins 22 allow the shroud to be positioned in a desired orientation in a handling device which moves the tube 10 as far as the support.

The fins 22 are notably intended to collaborate with the notches of complementary shape belonging to the handling device and form tube guide means. Because the shroud comprises four fins 22, it can be placed in the handling device in several orientations about the axis of the canal with respect to this device, so as to fit the shroud on the support in different orientations.

The shroud as described hereinabove makes it possible to dispense with the presence of a frame around it, and this makes it easier for the shroud to be fitted into the casting installation while at the same time offering a shroud the rigidity of which is sufficient to withstand the conditions to which it is subjected.

The method of manufacturing the shroud will now be described.

First of all, the tube body 12 is manufactured by extrusion, moulding or pressing. Next, once this shroud has been formed, the metallic jacket 17 is slipped over the end portion of the body 12. At this moment, at the end portion of the shroud, there is a space between the tube body 12 and the jacket 17.

A second material is then over-moulded between the tube body 12 and the jacket 17, this material filling the space between the tube body 12 and the jacket 17.

The benefit of such a manufacturing method is that a shroud with a square head or head of some other shape, which can be fitted to existing installations, can be manufactured while still using a fairly simple method of manufacture.

It will be noted that the invention is not restricted to the embodiment set out hereinabove.

For example, the tube body and the jacket may be made of materials other than those described. The head of the shroud may also have a cross section other than the one described.

Likewise, the means 20 of attachment to the drive means or the tube guide means may be shaped and laid out differently. For example, the shroud may have just two notches or, possibly, instead of these notches, may have a plurality of pins formed on the metallic jacket and that allows the shroud to be attached to the drive means.

Further, the shroud with sections of distinct shape can be manufactured without over-moulding a second material, even though that is more complicated.

The thickness and shape of the jacket may also differ from those described above, as long as the shroud is sufficiently rigid to withstand the casting method.

Numerous modifications and variations of the present invention are possible. It is, therefore, to be understood that within the scope of the following claims, the invention may be practiced otherwise than as specifically described.

The invention claimed is:

1. Ladle shroud for casting liquid metal, comprising a canal along which the metal can pass, extending essentially along an axis of the canal, and a metallic jacket positioned at an end portion of the shroud that corresponds to an end of the canal, wherein that the jacket comprises at least a belt of a thickness, perpendicular to the axis, of at least 10 mm, and wherein the shroud comprises means of attachment to tube drive means, the attachment means being formed on the belt of the jacket, and wherein the belt is an annular portion of the jacket.

2. Shroud according to claim 1, comprising, in the end portion, at least a cross section normal to the axis of the canal which differs, in a property selected from the group consisting of size and shape, from a property of a cross section of another portion of the shroud.

3. Shroud according to claim 1, wherein the metallic jacket is produced as a single piece.

4. Shroud according to claim 1, comprising a tube body made of a first material, and a second material overmoulded onto the body in the end portion of the shroud.

5. Shroud according to claim 1, wherein the belt of the jacket extends over at least one circumference of the shroud.

6. Shroud according to claim 1, ending in its end portion in a planar surface.

7. The ladle shroud of claim 1, wherein the belt has a thickness of at least 14 mm.

8. The ladle shroud of claim 2, wherein the cross section in the end portion of the shroud is square.

9. The ladle shroud of claim 4, wherein the second material is overmoulded onto the body between the body and the jacket.

* * * * *